US005296155A

United States Patent [19]

Reitz

[11] Patent Number: 5,296,155

[45] Date of Patent: Mar. 22, 1994

[54] STRATIFIED CARRIER ELECTROVISCOUS FLUIDS AND APPARATUS

[75] Inventor: Ronald P. Reitz, Hyattsville, Md.

[73] Assignee: The United States of America as represented by the Secretary of the Navy, Washington, D.C.

[21] Appl. No.: 826,202

[22] Filed: Jan. 24, 1992

Related U.S. Application Data

[63] Continuation of Ser. No. 584,964, Sep. 19, 1990, abandoned, which is a continuation-in-part of Ser. No. 219,522, Jul. 15, 1988, and a continuation-in-part of Ser. No. 219,523, Jul. 15, 1988, abandoned.

[51] Int. Cl.[5] ..... C10M 169/04; C10M 171/00

[52] U.S. Cl. ..... 252/73; 252/71; 252/74; 252/572

[58] Field of Search ..... 252/572, 73, 74, 75, 252/71

[56] References Cited

U.S. PATENT DOCUMENTS

| | | | |
|---|---|---|---|
| 3,367,872 | 2/1968 | Martinek | 252/74 |
| 3,397,147 | 8/1968 | Martinek | 252/78 |
| 3,427,247 | 2/1969 | Peck | 252/75 |
| 3,970,573 | 7/1976 | Westhaver | 252/73 |
| 3,984,339 | 10/1976 | Takeo | 252/74 |
| 4,129,513 | 12/1978 | Stangroom | 252/78.1 |
| 4,416,790 | 11/1983 | Schürmann et al. | 252/75 |
| 4,502,973 | 3/1985 | Stangroom | 252/73 |
| 4,645,614 | 2/1987 | Goossens | 252/75 |
| 4,687,589 | 8/1987 | Block | 252/78.1 |
| 4,737,886 | 4/1988 | Pedersen | 252/73 |
| 4,744,914 | 5/1988 | Filisko | 252/74 |
| 4,812,251 | 3/1989 | Stangroom | 252/75 |

FOREIGN PATENT DOCUMENTS

| | | |
|---|---|---|
| 63-97694 | 4/1988 | Japan . |
| 88/02434 | 4/1988 | World Int. Prop. O. . |

OTHER PUBLICATIONS

Chemical Abstracts, 93; vol. 16; 156360y, "Electrorheological Effect in Nonaqueous Suspensions", Petrzhik et al, 1980.

*Primary Examiner*—Christine Skane

*Attorney, Agent, or Firm*—Howard Kaiser; Charles D. Miller

[57] ABSTRACT

An improved electroviscous fluid formulated with discrete fluids of diverse densities, characterized in that settling of aggregate in functional apparatus is diminished. Aggregate particles having a density between the density of two fluids migrate to the boundary layer of the fluids when the fluids are at rest. By appropriately selecting the volume of the fluids in functional apparatus, the electroviscous fluid aggregate is placed in position for more immediate response when the apparatus is activated by electrical energy.

11 Claims, 3 Drawing Sheets

STRATIFIED CARRIER ELECTROVISCOUS FLUIDS AND APPARATUS

CROSS REFERENCE TO RELATED APPLICATIONS

This application is a continuation of application Ser. No. 07/584,964, filed Sep. 19, 1990, now abandoned which is a continuation in part of my co-pending patent applications Ser. No. 07/219,522 and 07/219,523, now abandoned, both filed Jul. 15, 1988, the disclosures of which are hereby incorporated by reference.

BACKGROUND OF THE INVENTION

Field of the Invention

This invention relates to the field of electroviscous fluids and more particularly to electroviscous fluids that exhibit long shelf life in storage and are adapted to avoid settling during application.

Background Information

Electroviscous fluids refer to fluids which exhibit the property of increased viscosity when the fluid is subjected to an electric field. One phenomenon for electrically controlling the viscosity of a fluid is commonly known as the Winslow effect. The term Winslow effect refers to the phenomenon of electrically controlling the viscosity of a fluid comprising a suspension of finely divided electrically polarizable matter in a dielectric fluid by subjecting the fluid to an electric field. Within this disclosure, the finely divided electrically polarizable matter is referred to as aggregate.

In my co-pending applications referenced above, it was disclosed that significant improvements in the performance of electroviscous fluids could be obtained by density matching the density of the carrier fluid with the density of the aggregate particles which are dispersed in the carrier. Although density matching of the aggregate with the fluid as previously disclosed improves the quality of the fluid, it has been noted that even a matched fluid has some tendency for the aggregate to settle out from the carrier fluid when the electroviscous fluid remains at rest for extended periods of time and also when the fluid is subjected to temperature changes. Thus, when the fluid is called upon to operate, the aggregate particles may not be in a position where they may be most advantageously influenced by an electric field. A significant change in density matched fluids occurs when the dielectric fluid is subjected to temperature changes.

There is a need for an electroviscous fluid that is more tolerant to conditions tending to induce settling than any fluid known presently to exist.

SUMMARY OF THE INVENTION

The present invention, a stratified carrier electroviscous fluid, consists essentially of a multiplicity of electrically polarizable aggregate particles and a plurality of nonmiscible dielectric carrier fluids. As used herein the term nonmiscible means not capable of being mixed in a manner resulting in a permanent loss of identity of the individual fluids. Preferably a portion of the aggregate particles has a density between the densities of two of the carrier fluids. The number of distinct fluids used may vary as long as a diversity of density exists between fluids. Two carrier fluids and three carrier fluids have been found to be practical. For two carrier fluids, one fluid preferably has a density greater than about 1.0 g/cc and one fluid has a density of less than about 1.0 g/cc. As will be shown in the detailed description, fluids are readily identifiable having these and the other characteristics needed for a stratified carrier electroviscous fluid. Three carrier fluids preferably have sufficient diversity of density so that a wide range of particle densities for the aggregate particles is practical.

In a three carrier fluid, a portion of the aggregate particles has a density between the density of a first fluid and the density of a second fluid and a portion of the aggregate particles has a density between the density of the second carrier fluid and the density of the third carrier fluid. Preferably substantially all of the aggregate particles have densities between the density of the first fluid and the third fluid. A convenient dividing line of practical fluids for use as first, second and third fluids is to make the density of the first fluid less than about 1.0 g/cc, the density of the second fluid as close to 1.0 g/cc as practical and the density of the third fluid greater than about 1.0 g/cc.

The aggregate may be hydrous or anhydrous. Where an anhydrous aggregate is desired, preferably the effectively anhydrous aggregate is in accordance with one of the aggregates disclosed in one of my copending applications referenced above. Such an aggregate consists essentially of a core and an electrically nonconductive shield, the core being at least partially electrically conductive and the shield partially encompassing the core, the shield adapted to prevent particle to particle transmission of electric current. Where an electrolyte is used as the core, a shell completely encapsulates the core. Thus, even though an electrolyte may contain water, the shell makes the aggregate effectively anhydrous because water in the electrolyte is not free to migrate into the dielectric. Preferably, each aggregate particle contains at least one buoyant body to aid in density matching the aggregate to the fluids. Hydrous aggregates are replete in the prior art.

Functionally, a portion of the aggregate tends to be suspended near the boundary layer between two fluids, not dense enough to settle through a first fluid and too dense to rise through a second fluid. Further, each individual fluid continues to retain, as in my copending applications, that portion of the aggregate as may be matched to each individual fluid. The individual fluids should retain their discrete characteristics, Although they should readily mechanically mix, each should not chemically react with nor permanently dilute another fluid. That is, the fluids should be nonmiscible. When the fluids are placed under a dynamic condition such as transporting the fluids through some machine or device, the fluids are mixed by agitation and aggregate will be dispersed by agitation throughout the fluid. A benefit of stratified fluids as herein disclosed is that when a fluid has been agitated and is again at rest, the discrete fluids will substantially physically separate and the aggregate will again migrate toward a boundary layer between two fluids, thus avoiding settling into the low parts of the machine or device so as to become inactive and not readily positioned for dynamic operation of the machine or device.

Three or more fluids are used to increase the range of particle densities that may be kept in suspension using stratified fluids of the present invention. Analogously as with fluids containing two discrete fluids, aggregate particles are supported by a first fluid of higher density and are beneath a fluid of a lower density. Thus, for as many different fluids (n) of different densities which do not chemically react with or permanently dilute each other as can be assembled, as electroviscous fluid having n−1 strata of aggregate may be formulated in accordance with the present invention.

Stratified carrier electroviscous fluids are used to make improved hydraulic systems such as for example, hydraulic power transmission apparatus. Therein, a stratified carrier electroviscous fluid is used to position electroviscous aggregate in an advantageous position for rapid response to an electrical command.

It is an object of the present invention to provide an electroviscous fluid that will position its electrically polarizable aggregate so as to be most effective when the system utilizing the fluid is activated.

It is another object of the invention to provide an electroviscous fluid that prevents a substantial portion of its aggregate from settling during periods of non use or storage.

It is yet another object of the invention to provide an electroviscous fluid that will improve the reliability and response times of hydraulic systems using such fluids.

It is still another object of the present invention to provide an electroviscous fluid where the aggregate does not tend to settle out as the fluid density changes as a function of temperature.

DETAILED DESCRIPTION OF THE INVENTION

Figure 1:
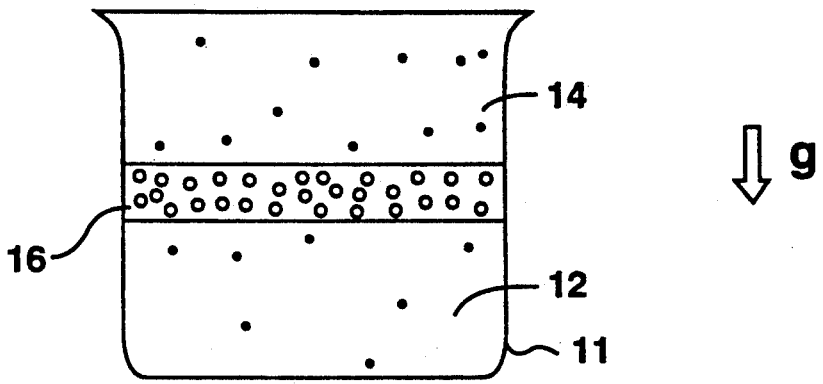
FIG. 1 is an illustration of a two carrier stratified fluid.

Referring now to FIG. 1, a two carrier embodiment of a stratified fluid of the present invention is illustrated. Within the foregoing description, the term carrier refers to a liquid used to formulate an electroviscous fluid. The term electroviscous fluid is used to designate a fluid comprising an electrically polarizable aggregate and one or more deilectric carrier fluids. In reservoir 11 an electroviscous fluid comprising first carrier 12 and second carrier 14 is shown at rest, that is, the first and second carrier fluids are not subject to any forces that would cause them to be agitated or tend to be mixed. Reservoir 11 and its contents are under the influence of acceleration such as gravity in the direction indicated by arrow g. Near the boundary layer between first carrier 12 and second carrier 14 is illustrated a collection of aggregate 16, the density of aggregate 16 being less than the density of first carrier 12 and greater than the density of second carrier 14. Aggregate 12 is any aggregate suitable for use in an electroviscous fluid, such as for example, one of the aggregates disclosed in my co-pending applications referenced above or again, for example, any prior art aggregate. First and second carriers are selected for their diversity in density and for qualities of not permanently mixing or reacting with each other, thus retaining their discrete characteristics when the fluids are at rest.

By way of example and not by limitation, the carriers listed in Table 1 have been found to be suitable for use in stratified carrier electroviscous fluids.

TABLE 1

| Carrier Reference Designation | Carrier Description |
|---|---|
| a | Mineral Oil of density of about 0.83 g/cc |
| b | Polyalkylene glycol of density of about 0.99 g/cc; |
| c | Glycerine of density of about 1.2 g/cc; |
| d | Dimethyl silicone oil of density of about .98 g/cc; |
| e | Phenyl silicone oil of density of about 1.05 g/cc; |
| f | Vegetable oil such as for example, sunflower oil, corn oil, peanut oil, having a density of about 0.9 g/cc; |

The following combinations of carriers have been found to be particularly useful in formulating two carrier fluids: ab, ac, bc, ad, ae, de, fd, fe, fb, fc, and dc, the letters referring to the fluids identified adjacent the corresponding letter in Table 1. Polyalkylene glycol, such as for example as distributed by UCON Fluids and Lubricants Div. of Union Carbide, South Charleston W. Va., under product number LB 385 is preferred for the carrier designated by the letter b and Phenyl silicone oil distributed by Dow Corning under product number SF 710 is preferred as the carrier designated by the letter e. The other carriers identified and referred to in Table 1 are generic carriers readily identifiable by those skilled in the art. Where room temperature operation is envisioned, combinations ab, ac, and bc are preferred because of cost considerations. Where elevated temperature operation is necessary, combinations ad, ae, and de are preferable because of the higher temperature capability of the carriers. Other carriers are expected to be suitable for use as long as they have appropriate temperature characteristics, are not readily permanently mixed, do not chemically react, and have sufficient diversity of density with respect to the density of the included aggregate.

Figure 2:
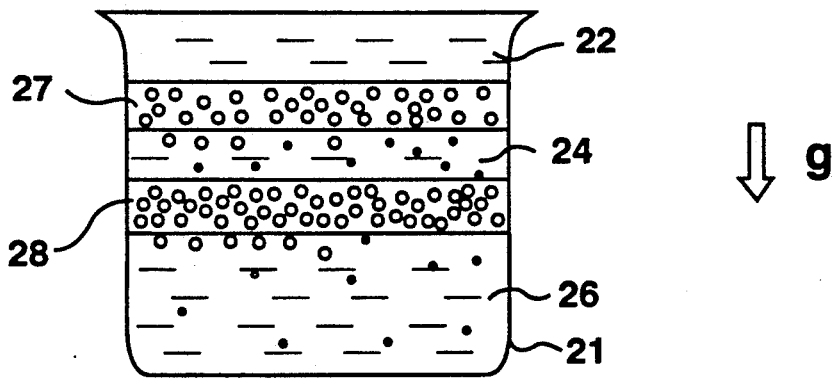
FIG. 2 is an illustration of a three carrier stratified fluid.

Referring now to FIG. 2 a three carrier embodiment of a stratified electroviscous fluid of the present invention is illustrated. In reservoir 21 an electroviscous fluid comprising first carrier 22, second carrier 24 and third carrier 26 is shown at rest, that is, it is not subject to any external forces that would cause the carriers to be mixed. Between first carrier 22 and second carrier 24 is illustrated a layer of a first aggregate 27, the density of aggregate 27 being between the density of first carrier 22 and second carrier 24. First aggregate 27 is again any aggregate such as for example, one of the aggregates disclosed in my co-pending applications identified above. Between second carrier 24 and third carrier 26 is illustrated a layer of a second aggregate 28, the density of aggregate 28 being between the density of second carrier 24 and third carrier 26. Aggregate 28 is again any aggregate such as for example, one of the aggregates disclosed in my co-pending applications as discribed above. First, second and third carriers are selected for their diversity in density and for qualities of not permanently mixing or reacting with each other. The following combinations have been found to be particularly useful in formulating three carrier electroviscous fluids of the present invention: abc, ade, fde, fbc, and fdc, the letters again referring to the carriers identified adjacent the corresponding letter in Table 1.

To further illustrate the function of the constituents of the preferred embodiments, the following examples are provided.

EXAMPLE 1

An aggregate was fabricated by mixing 450 ml of a surface treatment cement with 400 ml graphite powder, 200 ml aluminum powder of about 10 microns principal dimension, 1900 ml hollow glass microspheres of density about 0.2 g/cc and diameter on the order of 50 microns and 800 ml of water. The surface treatment cement was purchased at Channel Home Improvement Center in Lanham, Md. and is sold under the brand name Quikwall which is produced by the Quikrete Company in Atlanta, Ga. The graphite powder was obtained from Oceana, Ltd. in Annapolis, Md. The graphite powder was manufactured by the Gougeon Brothers, Inc., Bay City Mich., and sold under the brand name West System 423. The hollow glass microspheres are commercially available and were manufactured by the 3M Company, St. Paul, Minn. and sold under the name B23. The aluminum powder was purchased from Oceana, Ltd. in Annapolis, Md. and is sold by Gougeon Brothers, Inc., Bay City, Mich. under the Brand name West System 420. The aggregate mix was poured into a 5 gallon container, was mixed and was then left there for a period of one hour. Within 20 minutes after pouring the mixture into the container, it was observed that the mixture had swelled. Shortly thereafter it was observed that the mixture had hardened into a solid and was hot to the touch. Within two minutes it was noted that the hardened mixture cracked and steam began to rise out of the cracks. After 4 minutes the steam stopped and the aggregate mixture was permitted to cool.

One hour after the mix was poured into the 5 gallon container, the resultant solid aggregate was removed from the container and ground into a powder by hand. The powder was then strained through a tea strainer that had been purchased at the Giant Food Store in Lanham, Md. This powder that was strained through the strainer was the finished aggregate powder.

An electroviscous fluid was then fabricated by adding 1000 ml of finished aggregate powder to 600 ml mineral oil, 600 ml dimethyl silicone oil and 600 ml phenyl silicone oil. The mineral oil is sold under the Giant brand name by Giant Food the headquarters of which is located in Landover, Md. The mineral oil has a density of about 0.83 g/cc. The dimethyl silicone oil comprises SF 200 fluid produced and sold by the Dow Corning Corporation of Midland, Mich. The phenyl silicone oil comprises SF 710 fluid which is also produced and sold by the Dow Corning Corporation.

After mixing the electroviscous fluid thoroughly, four 50 ml quantities of the resulting electroviscous fluid were poured into four 60 ml centrifuge containers and placed in a centrifuge. The centrifuge is BHG Hermle model Z320 which is produced in West Germany.

The centrifuge was turned on at full and permitted to rotate at 4300 rpm for 10 minutes. After 10 minutes, the centrifuge containers were removed. It was observed that the electroviscous fluid in each container had stratified into layers of oil and particulate which are described in Table 2.

TABLE 2

| Layer Number | Content and Location in the Stratified Mixture |
|---|---|
| 1 | particulate; above the mineral oil layer |
| 2 | mineral oil; between layers 1 and 3 |
| 3 | particulate; between layers 2 and 4 |
| 4 | dimethyl silicone oil: between layers 3 and 4 |
| 5 | particulate; between layers 4 and 6 |
| 6 | phenyl silicone oil; between layers 5 and 7 |
| 7 | particulate; bottom layers, below layer 6 |

For each centrifuge container, the following procedure was conducted. Layer 1 was removed from the centrifuge container and discarded. Layers 2, 3, 4, 5 and 6 were then poured into a 500 ml container. Layer 7 was left in the centrifuge container and later removed and discarded when the containers were cleaned. The stratified carrier electroviscous fluid comprising layers 2, 3, 4, 5 and 6 is an example of a preferred embodiment of the invention and is also an example of an ade three liquid combination electroviscous fluid.

EXAMPLE 2

Another stratified carrier electroviscous fluid was made as in example 1 except that vegetable oil was used in place of the mineral oil used in example 1. The resultant mixture was centrifuged in like manner as described in example 1. The resultant stratified carrier electroviscous fluid comprises layers 2, 3, 4, 5 and 6. The vegetable oil used was food grade vegetable oil purchased from Giant Food Stores in Lanham, MD. The embodiment of example 2 is an fde combination three liquid electroviscous fluid where f, d and e are defined in Table 1.

It is appreciated that many other combinations of aggregates and dielectric fluids can be made without departing from the scope or spirit of the invention.

Figure 3:
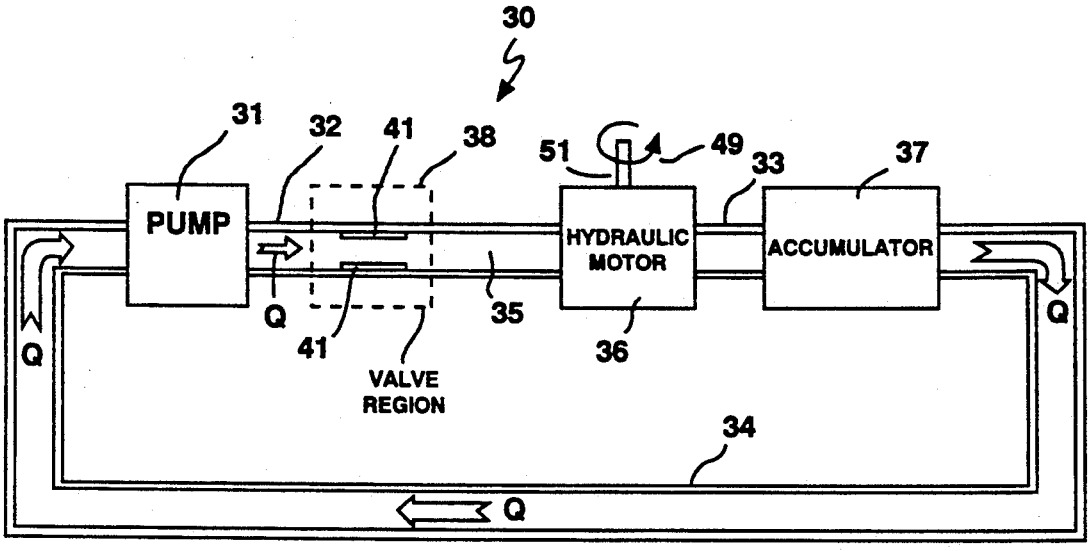
FIG. 3 is a schematic cross section of a hydraulic power transmission system using an electroviscous valve for control.
Figure 4:
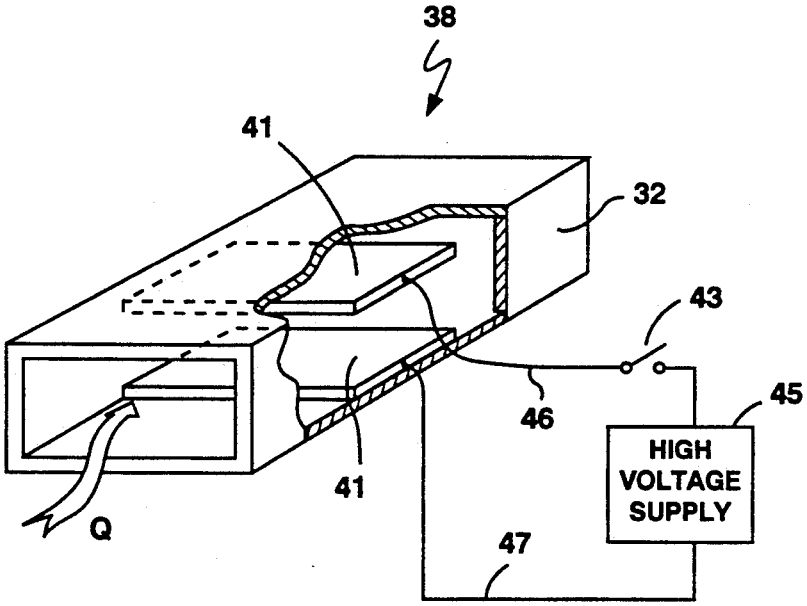
FIG. 4 is a partial break away perspective view of the valve portion of FIG. 4 shown with a control system.

The utility of a stratified carrier electroviscous fluid can be illustrated by reference to FIGS. 3, 4, 5 and 6. Referring to FIG. 3, an electroviscous fluid hydraulic system 30 comprises pump 31, electrically insulating ducts 32, 33 and 34, electroviscous fluid 35, hydraulic motor 36, accumulator 37 and electroviscous valve 38. Valve 38 is a region of duct 32 shown in FIG. 3 by a dashed line. Valve 38 is hydraulically connected to pump 31 on one end and hydraulically connected to motor 36 on the other end. Pump 31 comprises any suitable, commercially available hydraulic pump. Insulating ducts 32, 33 and 34 are preferably plastic and more preferably polyvinyl chloride (PVC) and preferably of rectangular cross section for use with flat electrode plates 41. Electroviscous fluid 35 may comprise any fluid embodiment of the present invention. Hydraulic motor 36 may comprise any suitable commercially available hydraulic motor. Fluid accumulator may comprise any suitable commercially available accumulator. Referring now to FIGS. 3 and 4, valve 38 comprises two electrically conductive plates 41 made from a suitable material such as for example, copper, bronze or steel. Plates 41 are substantially parallel to each other, are closely spaced from each other and are fixed to the interior of duct 32 as shown in FIG. 4. Plates 41 are spaced apart a suitable distance such as for example, about 3 milimeters. Other suitable spacings may also be selected to affect the operating characteristics of the system. Plates 41 are secured within duct 32 by suitable means such as bonding with a suitable adhesive.

Referring again to FIG. 4, electrode plates 41 of valve 38 are electrically connected to switch 43 and high voltage power supply 45 by means of electrically conductive wires 46 and 47 which are preferably made of copper. Wires 46 and 47 are physically and electrically attached to their respective electrodes and extend through duct 32 to switch 43 and power supply 45 as shown in FIG. 4.

Power supply 45 may be any suitable high voltage supply such as for example, a Glassman 30 kilovolt (kv), 50 milliamp (ma) high voltage power supply, Model PS/PH030P050. This power supply has the convenient features of both a tunable current limiter dial, which limits the maximum allowable output current and a tunable voltage limiter dial, which limits the maximum allowable output voltage. Each dial also has an adjacent corresponding milliamp meter and kilovolt meter, respectively. Unless otherwise specified, this supply was used in all tests of sample materials in accordance with the various examples. Switch 43 may be located within power supply 45 or externally as shown in FIG. 4.

In operation, pump 31 is turned on and pumps electroviscous fluid 35 through hydraulic system 30. Because switch 43 is open, valve 38 is not electrically energized and electroviscous fluid 35 flows through duct 32 in the direction indicated by the letter Q shown in FIG. 3 to hydraulic motor 36 which does useful work as indicated by arrow 49 at shaft 51.

The work performed by hydraulic motor 36 can be stopped or slowed by stopping or slowing, respectively, the flow of electroviscous fluid 35 into motor 36. This is accomplished by energizing valve 38. In operation, switch 43 is closed and high voltage power supply 45 energizes electrodes 41 of valve 38. Electroviscous fluid 35 between the electrodes of valve 38 solidifies or becomes appreciably more viscous when electrodes 41 are electrically energized than when electrodes 41 are not energized.

Figure 5:
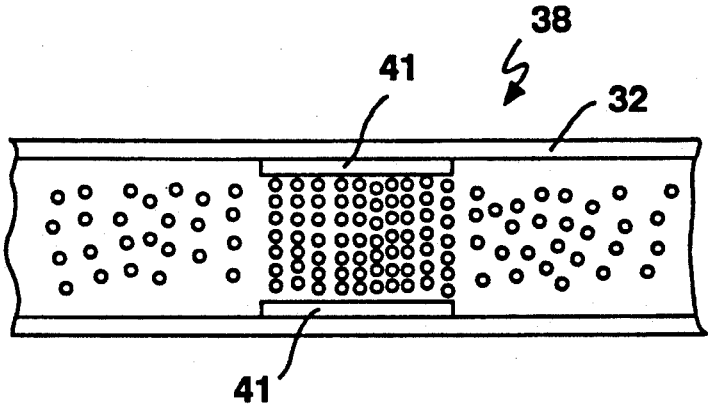
FIG. 5 illustrates the behavior of a stratified carrier fluid in the system of FIG. 3.
Figure 6:
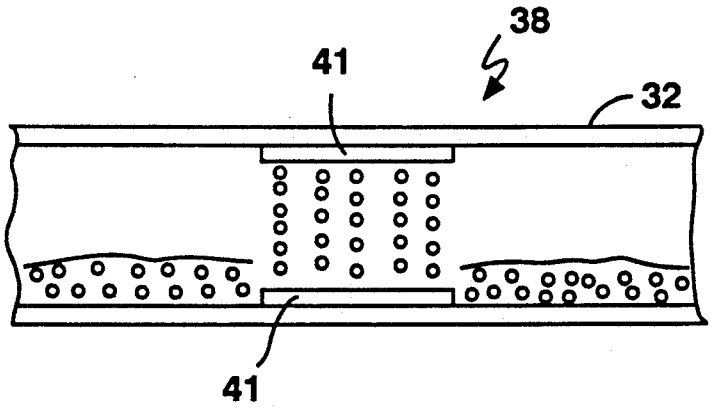
FIG. 6 illustrates the behavior of a conventional fluid in the system of FIG. 3.

The virtues of fluids of the present invention are more readily apparent by referring now to FIGS. 5 and 6. FIGS. 5 and 6, illustrate energized valve 38 and the electroviscous fluid 35 in the valve region of the duct 32 after valve 38 has been energized for a significant time period. FIG. 5 illustrates the situation when a fluid of the present invention is used as electroviscous fluid 35. As illustrated in FIG. 5, aggregate particles are maintained substantially within the electroviscous fluid 35 and can readily flow when electric power to valve 38 plates 41 is removed and plates 41 electrically discharge.

FIG. 6 illustrates the situation when a conventional fluid is employed as the electroviscous fluid and wherein the aggregate particles are more dense than the dielectric fluid of the electroviscous fluid 35. In this situation, the aggregate particles tend to sink upstream and downstream of the valve plates because there is little or no flow of electroviscous fluid 35 to maintain the suspension of the aggregate particles in the dielectric fluid. The particles settle to the bottom of the dielectric fluid and together form a sludge or slushy matter on the interior surface of duct 32. When the power to valve 38 is removed and the fluid flow is reestablished, the valve cannot again be closed by solidification of electroviscous fluid 35. This is because there are very few aggregate particles flowing in the dielectric fluid that flows between electrode plates 41 of valve 38.

Thus, utilization of the present invention is much more advantageous than with other electroviscous fluids.

It will be appreciated by those skilled in the art in the light of this disclosure that many other kinds of electroviscous fluid aggregate particles and many other carriers can be used without departing from the scope of the present invention.

It is further appreciated that electrogenerative particles, such as photoelectroviscous particles as taught in my copending application Ser. No. 07/219,523 or electrogenerative particles such as the piezoelectric particles in Example 1 above can be incorporated into the present invention. Such electrogenerative particles are advantageous and useful in making an electroviscous fluid responsive not only to an electric field but to light, in the case of photoelectric particulate or to changes in static pressure of the electroviscous fluid in the case of piezoelectric particulate.

It is to be understood that the embodiments herein described are only illustrative of the application of the principles of the invention and that numerous modifications, alternative embodiments and arrangements may be readily devised by those skilled in the art in the light of this disclosure without departing from the spirit and scope of this invention. It is therefore to be understood what within the scope of the appended claims, the invention may be practiced otherwise than as specifically described herein.

What is claimed is:

1. A stratified electroviscous fluid comprising:
a first fluid which is a dielectric and has a first density;
a second fluid which is a dielectric and has a second density which is greater than said first density; and
a plurality of particles having a third density which is greater than said first density but less than said second density;
said second fluid being immiscible with said first fluid;
said particles having the characteristic that they polarize in the presence of an electric field;
a substantial number of said particles each comprising a core and an electrically nonconductive shield;
said core being at least partially electrically conductive;
said shield partially encompassing said core;
said shield adapted to prevent particle to particle transmission of electric current;
whereby, in a settled state, said electroviscous fluid will stratify into a first layer comprised substantially of said second fluid and a second layer comprised substantially of said first fluid, and said particles will be suspended in said electroviscous fluid substantially between said first layer and said second layer.

2. An electroviscous fluid as claimed in claim 1, wherein each of said particles comprises a hollow buoyant body.

3. An electroviscous fluid as claimed in claim 1, wherein said first fluid has a density lower than about 1.0 g/cc and said second fluid has a density greater than about 1.0 g/cc.

4. An electroviscous fluid as claimed in claim 1, wherein said first fluid is mineral oil having a density for about 0.83 g/cc and said second fluid is a fluid selected from the group consisting of polyalkylene glycol having a density of about 0.99 g/cc, glycerine having a density of about 1.2 g/cc, dimethyl silicone oil having a density of about 0.98 g/cc, and phenyl silicone oil having a density of about 1.05 g/cc.

5. An electroviscous fluid as claimed in claim 1, wherein said first fluid is polyalkylene glycol having a density of about 0.99 g/cc and said second fluid is glycerine having a density of about 1.2 g/cc.

6. An electroviscous fluid as claimed in claim 1, wherein said first fluid is dimethyl silicone oil having a density for about 0.98 g/cc and said second fluid is phenyl silicone oil having a density of about 1.05 g/cc.

7. An electroviscous fluid as claimed in claim 1, wherein said first fluid is vegetable oil having a density of about 0.90 g/cc and said second fluid is a fluid selected from the group consisting of polyalkylene glycol having a density of about 0.99 g/cc, glycerine having a density of about 1.2 g/cc, dimethyl silicone oil having a density of about 0.98 g/cc and phenyl silicone oil having a density of about 1.05 g/cc.

8. An electroviscous fluid as claimed in claim 1, wherein said core comprises piezoelectric material.

9. An electroviscous fluid as claimed in claim 1 or claim 12, wherein said shield comprises at least one buoyant body.

10. An electroviscous fluid as claimed in claim 1, wherein said nonconductive shield comprises cement.

11. An electroviscous fluid as claimed in claim 10, wherein said nonconductive shield further comprises a buoyant body enclosed in said cement.

* * * * *